US005744911A

United States Patent [19]

Kim et al.

[11] Patent Number: 5,744,911

[45] Date of Patent: Apr. 28, 1998

[54] DEVICE FOR DRIVING DIRECTLY HEATED CATHODE OF CATHODE RAY TUBE

[75] Inventors: Sang-kyun Kim, Seoul; Chang-seob Kim; Hak-cheol Yang, both of Suwon, all of Rep. of Korea

[73] Assignee: Samsung Display Devices Co., Ltd., Kyungki-do, Rep. of Korea

[21] Appl. No.: 576,589

[22] Filed: Dec. 21, 1995

[30] Foreign Application Priority Data

Dec. 28, 1994 [KR] Rep. of Korea ..... 94-38308

[51] Int. Cl.[6] ..... H01J 29/98

[52] U.S. Cl. ..... 315/94; 315/105; 315/411

[58] Field of Search ..... 315/94, 101, 102, 315/103, 104, 105, 106, 107, 291, 95, 96, 97, 411, 309

[56] References Cited

U.S. PATENT DOCUMENTS 5,130,606 7/1992 Morrish et al. ..... 315/107

*Primary Examiner*—Robert Pascal

*Assistant Examiner*—David Vu

*Attorney, Agent, or Firm*—Leydig, Viot & Mayer, Ltd.

[57] ABSTRACT

A device for driving a directly heated cathode of a cathode ray tube eliminating a delay due to inductance of a transformer. A transformer that produces the heater-heating signal voltage applied to the cathode includes a secondary coil divided into first and second coils. The voltage induced in the first coil is used for the heater-heating voltage and the signal induced in the second coil is synchronized with the voltage induced in the first coil and used as a bias voltage for turning on and off a switching element in synchronization with the heater-heating voltage. The switching element turns on only when the heater-heating signal voltage is applied to a control terminal of the switching element.

2 Claims, 2 Drawing Sheets

DEVICE FOR DRIVING DIRECTLY HEATED CATHODE OF CATHODE RAY TUBE

BACKGROUND OF THE INVENTION

The present invention relates to a device for driving a directly heated cathode of a cathode ray tube, and more particularly, to a device for driving a directly heated cathode of a cathode ray tube which eliminates delay of an image signal applied to a cathode due to the inductance of the transformer coil which provides a pulse voltage applied to the heater.

FIG. 1A is a circuit diagram showing a prior art cathode of a cathode ray tube directly heated.

Referring to FIG. 1A, Ek is an image signal voltage applied to a cathode, and which compresses signal voltages of red (R), green (G), and blue (B), and a pulse wave having a frequency of 15.75 KHz. A pulse voltage of 6.3 V and having a frequency of 15.75 KHz is provided to the heater (H) as a voltage source for driving the heater and is transmitted through a transformer (T). FIG. 1 shows only one secondary coil, but three secondary coils responding to R, G, B respectively are provided in actual devices. Resistive heating elements Rh1 and Rh2 are equivalent resistances to the heater coil. A capacitor $C_G1$ is positioned between the cathode and the first grid. The capacitor is a distributed capacitance.

In the device for driving the directly heated cathode of the cathode ray tube configured as described above, a cathode (K), a heater (H) and grids ($G_1$, $G_2$ and $G_3$) are positioned in the picture tube as shown in FIG. 1B. Cathode (K) is an electrode for emitting a hot electron, the heater (H) heats the cathode (K), and grids ($G_1$, $G_2$, $G_3$) accelerate or focus the hot electron emitted from cathode.

However, an image signal output by using the device for driving the directly heated cathode of the cathode ray tube is delayed due to the inductance in the secondary coil as shown in FIG. 1C, and therefore, a blurring phenomenon occurs on the screen of the picture tube as shown in FIGS. 1D and 1E.

SUMMARY OF THE INVENTION

An object of the present invention is to provide a device for driving a directly heated cathode of a cathode ray tube which prevents delay of image signal voltage due to the inductance of a transformer providing a heater pulse voltage and thus eliminates the problem of blurring on screen.

To achieve the above object, the present invention is directed to a device for driving a directly heated cathode of a cathode ray tube having a cathode, a heater for heating the cathode, image signal supplying means, and heater-heating signal voltage supplying means. The device for driving a direct-heating type cathode signal further comprises:

a transformer for receiving the heater-heating signal voltage of the heater-heating signal voltage supplying means at a primary coil and transforming the received voltage and transmitting a transformed voltage through at least first and secondary coils of a secondary coil to the heater;

a diode for obtaining a one-way component of a predetermined voltage from a first coil of the secondary coil; and means for switching, the means for switching being synchronized with the voltage of the first coil so that the voltage of the first coil obtained through the diode flows to the heater, and switching by a predetermined signal voltage of a second coil, among partial voltages from said secondary port coil.

According to the present invention, it is preferable that the switching means comprises at least one element selected from the group consisting of a bipolar transistor, an IGBT, an SCR, and an FET, and switched so that the signal voltage from the second coil of the secondary coil is applied to a base or a gate, thereby applying the voltage of the first coil to the heater.

BRIEF DESCRIPTION OF THE DRAWINGS

The above object and advantage of the present invention will become more apparent by describing in detail a preferred embodiment thereof with reference to the attached drawings in which.

DETAILED DESCRIPTION OF THE INVENTION

Hereinafter, a device for driving a directly heated cathode of a cathode ray tube according to the present invention will be described with reference to the attached drawings.

Figure 1A:
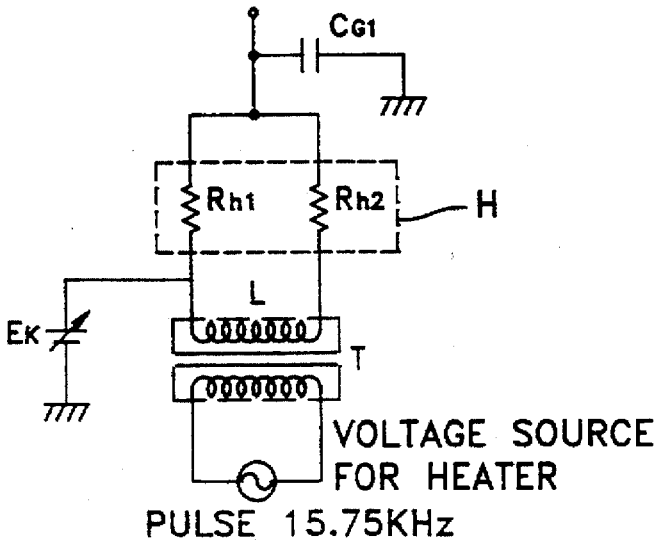
FIG.1A (PRIOR ART)
FIG. 1A is a circuit diagram illustrating a device for driving a directly heated cathode of a cathode ray tube according to prior art.
Figure 1B:
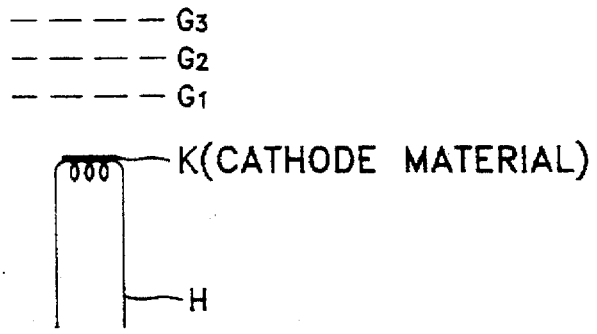
FIG.1B (PRIOR ART)
FIG. 1B is a diagram for explaining the position of a cathode, a heater and grids in a picture tube according to prior art.
Figure 1C:
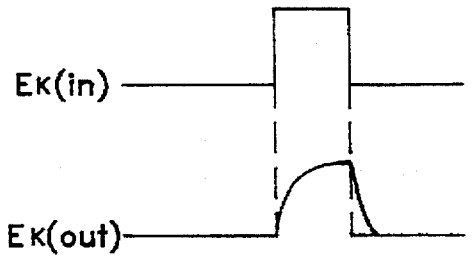
FIG.1C (PRIOR ART)
FIG. 1C is a waveform illustrating a signal delay phenomenon in the conventional device as shown in FIG. 1A.
Figure 1D:
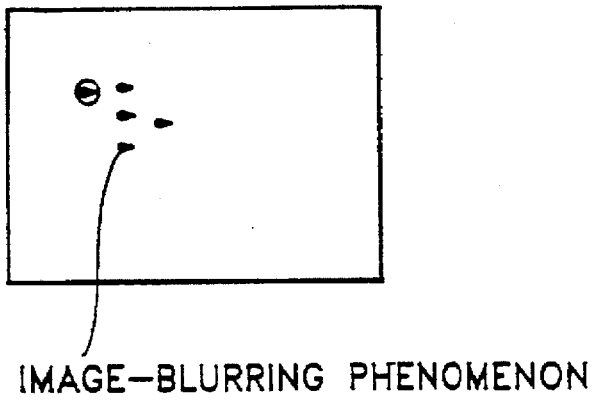
FIG.1D (PRIOR ART)
FIG. 1D is a view illustrating blurring on the screen of the picture tube due to a signal delay as shown FIG. 1C
Figure 1E:
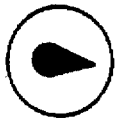
FIG.1E (PRIOR ART)
FIG 1E is a detailed view of FIG 1D.
Figure 2:
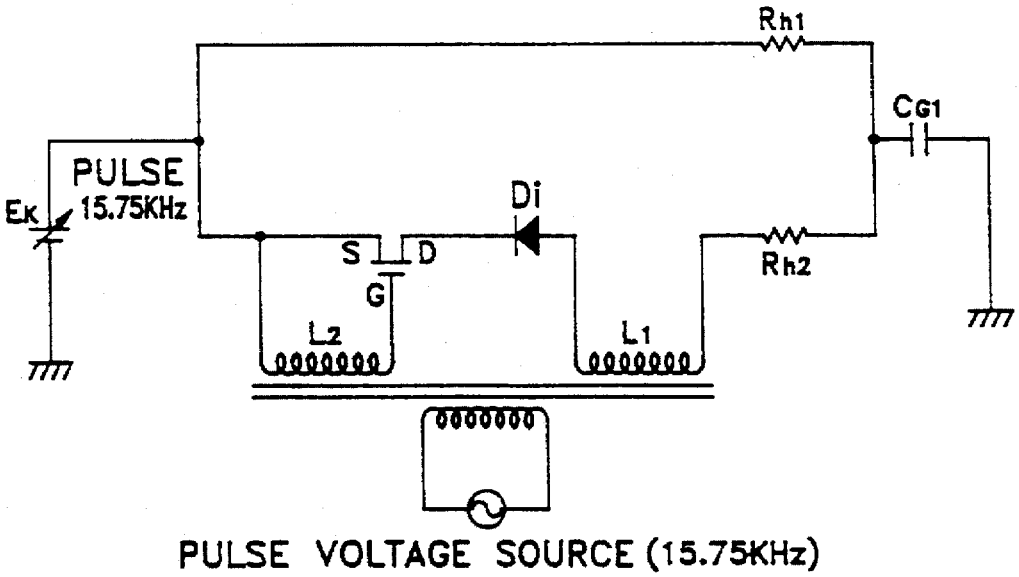
FIG. 2 is a circuit diagram of a device for driving a directly heated cathode of a cathode ray tube according to the present invention.

FIG. 2 is a circuit diagram of an exemplary device for driving a directly heated cathode of a cathode ray tube.

Referring to FIG. 2, Ek is an image signal voltage which comprises signal voltages of red, green and blue signals, and a pulse train having a frequency of 15.75 KHz, which may be applied to a cathode. A voltage source for driving a heater provides the heater with a 6.3 volt pulse voltage signal which is synchronized with the image signal, thereby avoiding signal interference generated between the heater and the cathode, and transmits the pulse voltage through transformer (T). In the transformer, the secondary coil includes a first coil ($L_1$) and a second coil ($L_2$) according to the number of windings of the secondary coil, wherein the first coil ($L_1$) is series-connected to a diode (Di) and the second coil (L2) is connected to the FET. Resistive heating elements Rh1 and Rh2 are equivalent to the heater coil, and $C_G1$ is the distributed capacitance between the cathode (K) and the first grid ($G_1$).

In the device for driving the directly heated cathode of the cathode ray tube according to the present invention, gate (G) of the FET is connected to one terminal of the second coil ($L_2$), the source (S) is connected to another terminal of second coil ($L_2$), and the drain (D) is connected to diode (Di). Accordingly, by using the signal voltage for biasing (which is induced in the second coil $L_2$) synchronized with the heater-heating voltage induced in the first coil ($L_1$), the FET is turned on so that the heater-heating voltage induced in first coil ($L_1$) is applied to the heater. Therefore, the image signal voltage pulse input to cathode material K is not influenced by the inductance of the secondary coil and thus the signal delay phenomenon does not occur. Other elements may be utilized instead of the FET, for example, switching elements such as a bipolar transistor, an IGBT, and an SCR can be used.

As described above, for the device for driving the directly heated cathode of the cathode ray tube according to the present invention, the secondary coil of the transformer which generates the heater-heating signal voltage is divided into two coils, and the voltage induced in the first coil is then used as a heater-heating voltage and the signal voltage induced in second coil ($L_2$), which is synchronized with the voltage of the first coil, is used as a bias voltage which turns the switching element (FET) on, thereby switching the switching element so as to be synchronized with the heater-heating voltage induced in first coil ($L_1$) to heat the heater. Accordingly, the switching element turns on only at the moment when the heater-heating signal voltage is applied to the gate of the switching element, whereby the device of the present invention is free from the time delay phenomenon of the image signal influenced by the inductance of the secondary coil.

What is claimed is:

1. A device for driving a directly heated cathode of a cathode ray tube having a cathode, a heater for heating the cathode, image signal supplying means, and heater-heating signal voltage supplying means, the device for driving the directly heated cathode of the cathode ray tube comprising:

a transformer having primary and secondary coils for receiving a heater-heating signal voltage of a heater-heating signal voltage supplying means at said primary coil, for transforming the received voltage, for transmitting a transformed voltage from said secondary coil to a heater, said secondary coil including first and second coils;

a diode for producing a unidirectional component of a voltage induced in said first coil of said secondary coil; and means for switching connected to said second coil and switching in synchronization with the voltage induced in said first coil so that a current from said first coil flows through said diode to the heater.

2. The device for driving a directly heated cathode of a cathode ray tube as claimed in claim 1, wherein said switching means is selected from the group consisting of a bipolar transistor, an IGBT, an SCR, and an FET, and is switched when a signal voltage from said second coil of said secondary coil is applied to a base or a gate of said switching means, thereby applying the voltage induced in said first coil to the heater.

* * * * *